United States Patent [19]

Yotsukura

[11] 4,129,376

[45] Dec. 12, 1978

[54] ELECTROPHOTOGRAPHIC APPARATUS

[75] Inventor: Teruo Yotsukura, Hitachi, Japan

[73] Assignee: Hitachi, Ltd., Japan

[21] Appl. No.: 695,759

[22] Filed: Jun. 14, 1976

[30] Foreign Application Priority Data

Jun. 16, 1975 [JP] Japan ..... 50-71878

[51] Int. Cl.[2] ..... G03G 15/00; G03G 15/28

[52] U.S. Cl. ..... 355/11; 355/3 R; 355/51

[58] Field of Search ..... 355/3 R, 8, 11, 51

[56] References Cited

U.S. PATENT DOCUMENTS

| | | | |
|---|---|---|---|
| 2,845,841 | 8/1958 | Collins | 355/51 |
| 2,940,358 | 6/1960 | Rosenthal | 355/11 X |
| 3,331,592 | 7/1967 | Cassano et al. | 355/11 X |
| 3,386,379 | 6/1968 | Gundlach et al. | 250/315 X |
| 3,776,629 | 12/1973 | Ogawa | 355/11 X |
| 3,976,372 | 8/1976 | Miyata et al. | 355/4 |
| 3,992,093 | 11/1976 | Jakobson | 355/51 |

*Primary Examiner*—Fred L. Braun
*Attorney, Agent, or Firm*—Craig & Antonelli

[57] ABSTRACT

An image on an original (hereinafter referred to as an "original image") is exposed as an erect image on a photoconductive recording medium by a first optical system, and as an image by inversion (hereinafter referred to as an "inverted image") by a second optical system. The first and second optical systems are established by selectively moving a mirror lens or a prism lens, respectively, into the optical path formed between the original and the photoconductive recording medium. A charged latent image formed on the photoconductive recording medium by the inverted image exposure is developed by a toner containing a sublimable dye. The inverted image on the recording medium thus developed by the toner containing the sublimable dye is utilized as a copy master for heat transfer to another recording medium.

3 Claims, 10 Drawing Figures

ELECTROPHOTOGRAPHIC APPARATUS

BACKGROUND OF THE INVENTION

1. Field of the Invention

This invention relates to an electrophotographic apparatus, or more in particular to an electrophotographic apparatus capable of selectively producing either an ordinary electrophotographic copy or a copy master developed by a toner containing a sublimable dye and thermally transferable to another recording medium.

2. Description of the Prior Art

An image depicted on such a primary recording medium as paper or cloth by means of a sublimable dye may be thermally transferred to a desired secondary recording medium such as paper or cloth. This thermal transfer is easily accomplished by ironing the primary recording medium, namely, copy master carrying an original image, which is superposed on the secondary recording medium. Several operations of heat transfer are possible on one sheet of copy master. In this type of copying, the image formed on the secondary recording medium must be an erect image, requiring an inverted image to be formed on the copy master. In the prior art, such a copy master is produced by offset printing. The production of the copy master by offset printing process, though convenient for mass production of masters involving a single image, is not an economical means for producing copy masters of a variety of different images, each in a small number. Further, this offset printing process is not a suitable method for quickly producing copy masters of images tailored to individual requirements. To overcome this problem, a process for producing a copy master by electrophotography has been suggested. This electrophotographic process of copy master production is possible by the same operation as an ordinary copying machine and therefore provides a convenient means for copying a great variety of images desired by individuals. This copying machine for producing copy masters, if constructed to include an optical system for forming an inverted copy image and use a developing toner containing a sublimable dye, may be fabricated in the same manner as an ordinary electrophotographic apparatus. Application of the electrophotographic apparatus as a single-purpose machine only to the production of copy masters reduces the utilization factor of the machine, resulting in a higher unit cost of copy masters.

SUMMARY OF THE INVENTION

It is an object of the present invention to provide an electrophotographic apparatus capable of producing a copy master developed with a toner containing a sublimable dye.

Another object of the invention is to provide an electrophotographic apparatus capable of selectively producing an ordinary copy and a copy master.

Still another object of the invention is to provide an electrophotographic apparatus capable of selectively producing an erect-image copy and an inverted-image copy.

The electrophotographic apparatus according to the present invention comprises a station carrying an original (hereinafter referred to as an "original station"), a photoconductive recording medium, a charger for uniformly charging the recording surface of the photoconductive recording medium, an optical system for exposing to light the recording surface of the uniformly-changed photoconductive recording medium in accordance with the original image thereby to produce a charged latent image coincident with the original image on the recording surface, and a developer for developing the charged image on the recording surface. The optical system includes selectively-usable first and second light paths, the former for projecting an erect image of the original on the recording surface, and the latter for projecting an inverted image of the original. The developer uses a toner containing a sublimable dye at least for the recording surface exposed with an inverted image.

DETAILED DESCRIPTION OF THE PREFERRED EMBODIMENTS

Figure 1:
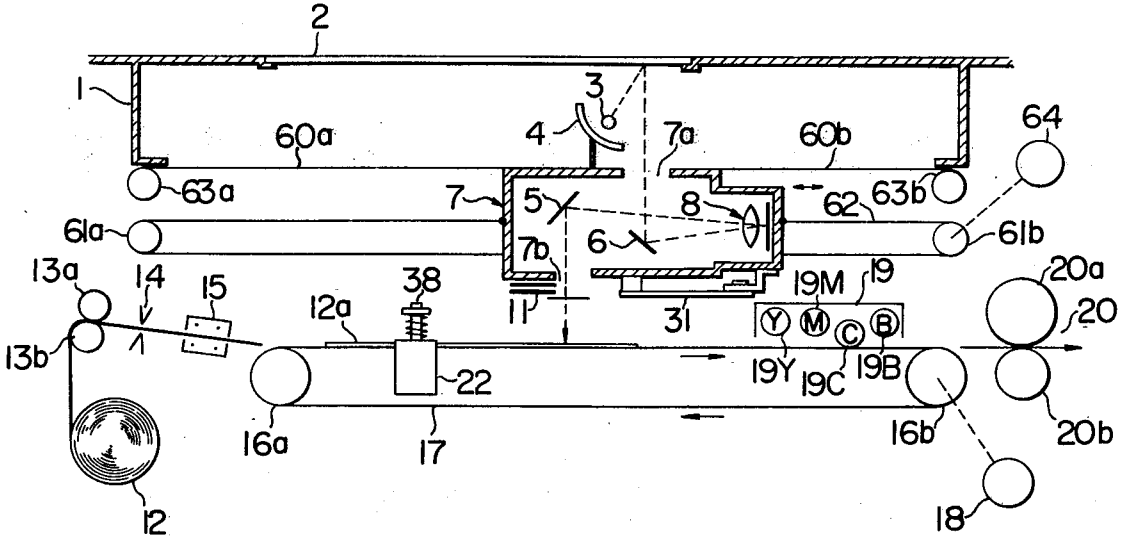
FIG. 1 is a longitudinal side view showing an electrophotographic apparatus according to the present invention.
Figure 2:
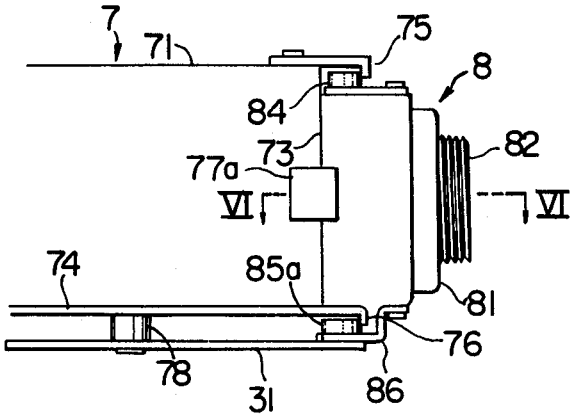
FIG. 2 is a side view showing the switching section of a reflector.
Figure 3:
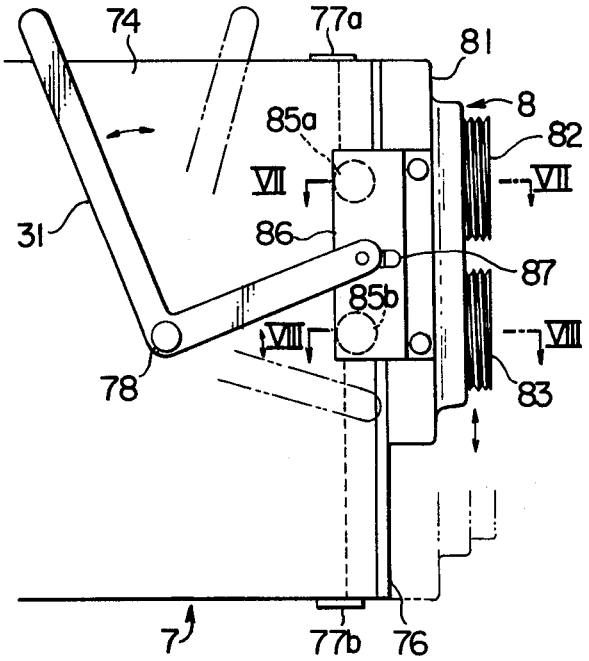
FIG. 3 is a bottom view of FIG. 2.

In FIG. 1, reference numeral 1 shows the frame of an electrophotographic apparatus, and numeral 2 a station where an original is disposed. The original station 2 is comprised of a sheet of transparent glass plate fitted over the opening formed in the frame 1. Numeral 3 shows a lamp for radiating light on the original, which is mounted, together with a condenser reflector 4, on an optical box 7. The optical box 7 includes a slit *7a* for incident light and a slit *7b* for outgoing light. A filter 11 for color separation is provided on the outside of the slit *7b*. Numerals 5 and 6 show flat mirrors, and numeral 8 a switchable reflector containing a mirror lens and a prism lens. Numeral 12 shows a roll of paper with its recording surface treated to give photoconductivity. The photoconductive recording medium supplied from the paper roll 12 through guide rollers **13*a* and 13*b* is cut into a predetermined size by the cutter 14, and then the recording surface is uniformly charged by a charger 15. A unit of the photoconductive recording medium 12*a* thus obtained is held in a predetermined exposing position by the carrier belt 17, which is suspended between the guide rollers 16*a* and 16*b* and adapted to be driven by the motor 18 in the direction of the arrow. The optical box 7 is disposed between the original station 2 and the carrier belt 17 and supported by a not-shown guide rail slidably in parallel to the original station 2 and the carrier belt 17. The portions of the apparatus on both sides of the optical box 7 are covered with light-blocking screens 60*a* and 60*b* respectively, so that only that part of the light reflected on the original on the original station 2 that has passed the slits *7a* and *7b* of the optical box 7 is projected on the recording medium unit 12*a*. The optical box 7 is held by the wire rope 62** hung between the guide rollers 61a and 61b so as to be slidable in the direction of arrow. Thus the outer ends of the light-blocking screens 60a and 60b are adapted to be automatically go into or out of the containers 63a and 63b respectively. Numeral 64 shows a motor for driving the guide pulley 61b. Numeral 31 shows a switching lever mounted on the under side of the optical box 7. By swinging the lever 31, the mirror lens and the prism lens contained in the reflector 8 are switched relative to each other. The swinging of the lever 31 is caused as the lever 31 strikes the engaging roller 38 adjacent to the carrier belt 17 in response to the sliding movement of the optical box 7. The position of the engaging roller 38 is so controlled by the electromagnet 22 that when the lever 31 is to be swung, the roller 38 is projected into the operating locus of the lever 31, while when no swinging operation is intended, it is retreated out of the operating locus of the lever 31. Numeral 19 shows a developer having a plurality of developing units 19Y, 19M, 19C and 19B, each of which is a well-known magnetic brush developing unit. Such a magnetic developing unit is disclosed in detail, for example, by U.S. Pat. No. 3,455,276 (filed May 23, 1967 Ser. No. 640,720 by Glenn R. Anderson) and U.S. Pat. No. 3,909,258 (filed Jan. 2, 1974 Ser. No. 430,044 by Authur R. Kotz). The developing unit 19Y employs yellow toner, the developing unit 19M magenta toner, the developing unit 19C cyan toner and the developing unit 19B black toner. These sublimable toners are described in detail in the Japanese Patent Publication No. 107937/75 (Patent application No. 4696/75). The developer 19 is for developing the charged image on the recording medium unit 12a passing thereunder. The developing units 19Y to 19B actually used are selected in accordance with the color of the filter 11 used for exposure. The recording medium unit 12a thus developed is moved to the fixer 20, where a toner image is securely fixed on the recording medium unit 12a, the fixer 20 being comprised of pressure rollers 20a and 20b.

Now, the explanation will be made of the reflector 8 in the optical box 7 and the switching system thereof. The manner in which the reflector 8 is mounted in the optical box 7 is depicted in detail in FIGS. 2, 3, 6, 7 and 8. Reference numeral 71 shows a case with an end 73 having a window 72, outside of which a lens holder 81 is slidably mounted. The mirror lens 82 and the prism lens 83 are screwed into the lens holder or lens barrel 81 in such a manner as to reflect the optical image passed through the window 72. The screwing of the mirror lens 82 and the prism lens 83 facilitates the adjusting of the reflecting position back and forth. The underside of the lens holder 81 is adapted to slide along the extension of the bottom cover 74 of the case 71, whereas the side thereof is adapted to slide on the end surface 73 of the case 71. This construction is made possible by the fact that the guide rollers 84, 85a and 85b on the upper and lower sides of the lens holder 81 engage the guide rails 75 and 76 extending from the case 71. Numerals 77a and 77b show stoppers mounted on the case 71 for exactly defining the stop position of the slidable lens holder 81. The guide rollers 85a and 85b are mounted on the engaging piece 86 on the underside of the lens holder 81 and engage the guide rail 87 from underside. The engaging piece 86 has a slot which is engaged by an end of the switching lever 31. The intermediate part of the lever 31 horizontally swingingly engages the post 78 erected on the bottom cover 74. The other end of the lever 31 is adapted to strike the engaging roller 38 in response to the movement of the optical box 7.

Figure 4:
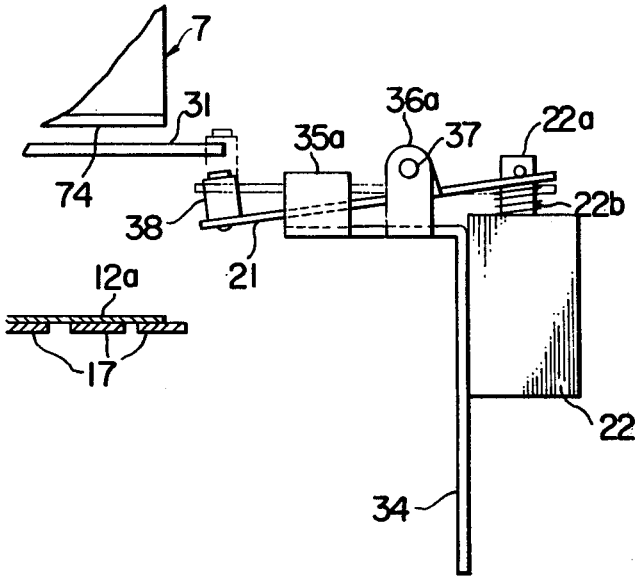
FIG. 4 is a side view of a switching control system.
Figure 5:
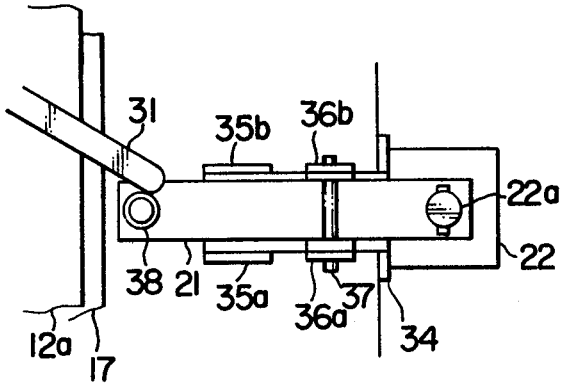
FIG. 5 is a plan view of FIG. 4.
Figure 6:
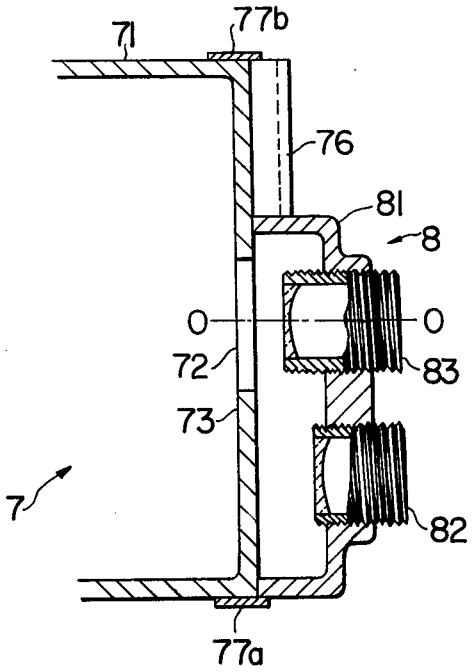
FIG. 6 is a sectional view taken in the line VI—VI in FIG. 2.
Figure 7:
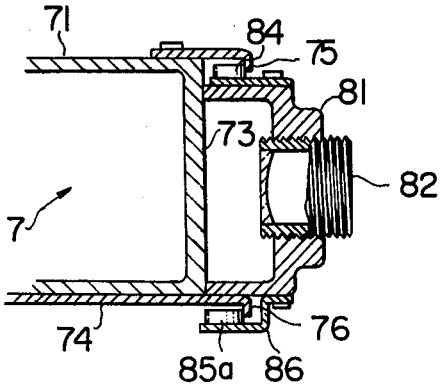
FIG. 7 is a sectional view taken in the line VII—VII in FIG. 3.
Figure 8:
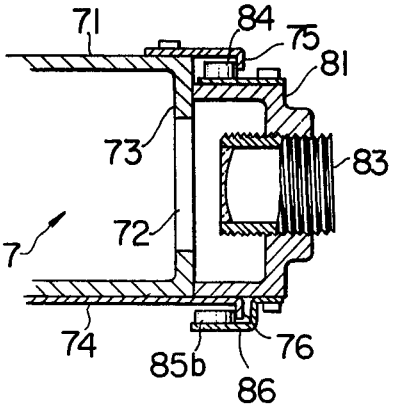
FIG. 8 is a sectional view taken in the line VIII—VIII in FIG. 3.

The relation between the lever 31 and the engaging roller 38 is illustrated in detail in FIGS. 4 and 5. In FIG. 4, the optical box 7 together with the lever 31 moves in either of the directions perpendicular to the page. The engaging roller 38 is mounted on an end of the lever 21. The lever 21 is supported at an intermediate point thereof by a pin 37 held between the supporting points 36a and 36b. The other end of the lever 21 is engaged with the plunger 22a of the electromagnet 22. As long as the coil (not shown) remains de-energized, the plunger 22a is held at its upper position by the spring 22b thereby to maintain the lever 21 at the position shown by the solid line in the drawing. Under this condition, if the optical box 7 moves, accompanied by the movement of the lever 31, the forward end of the lever 31 fails to strike the engaging roller 38. Once the coil of the electromagnet 22 is energized, however, the plunger 22a is retreated against the force of the spring 22b and therefore the lever 21 rotates to the position shown by a chain line. As a result, the roller 38 projects into the operating locus of the lever 31. Under this condition, the movement of the optical box 7 causes the lever 31 to strike the roller 38, so that the lever 31 swings to the position shown by the solid line or chain line in FIG. 3, thereby sliding the lens holder 81 in the direction of the arrow. When the lens holder 81 moves in either of the directions shown by the arrow, the mirror lens 82 or the prism lens 83 is opposed to the window 72, with the result that the optical image passing through the slit 7a to the slit 7b makes up an erect image or inverted image, as the case may be. In the embodiment under consideration, light passing through the mirror lens 82 causes an erect optical image to be projected on the recording medium unit 12a, whereas the light passing through the prism lens 83 contributes to the projection of an inverted optical image on the recording medium unit 12a. Numerals 35a and 35b show engaging members formed on the engaging station 34 to prevent the lever 21 from being bent in the horizontal direction.

Figure 9:
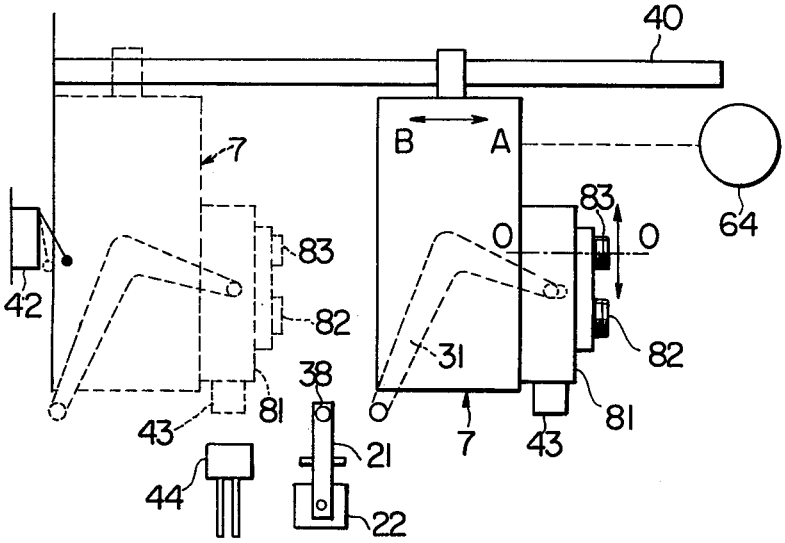
FIG. 9 is a plan view of the optical system for explaining the switching control.

A plan view of the optical system is shown in FIG. 9 for explaining the operation of the switching system. In this figure, neither slit 7a, lamp 3 or reflector 4 mounted on the optical box 7 is shown. The guide rail 40 for guiding the movement of the optical box 7 is diagrammatically illustrated. In the drawing, the optical box 7 is in a stationary position shown by the dashed line, where the limit switch 42 is provided for determining whether or not the optical box 7 is in the stationary position. The magnet 43 is disposed on the end surface of the lens holder 81, so that the switch 44 of magnetic response type is located opposedly to the magnet 43 when the optical box 7 is in its stationary position. The switch 44 is adapted to be closed when the optical box 7 reaches the stationary position in the state of the prism lens 83 in registration with the optical axis O—O or the window 72. As long as the mirror lens 82 is in a position in registration with the optical axis O—O, on the other hand, the switch 44 will not be closed even when the optical box 7 reaches the stationary position.

Figure 10:
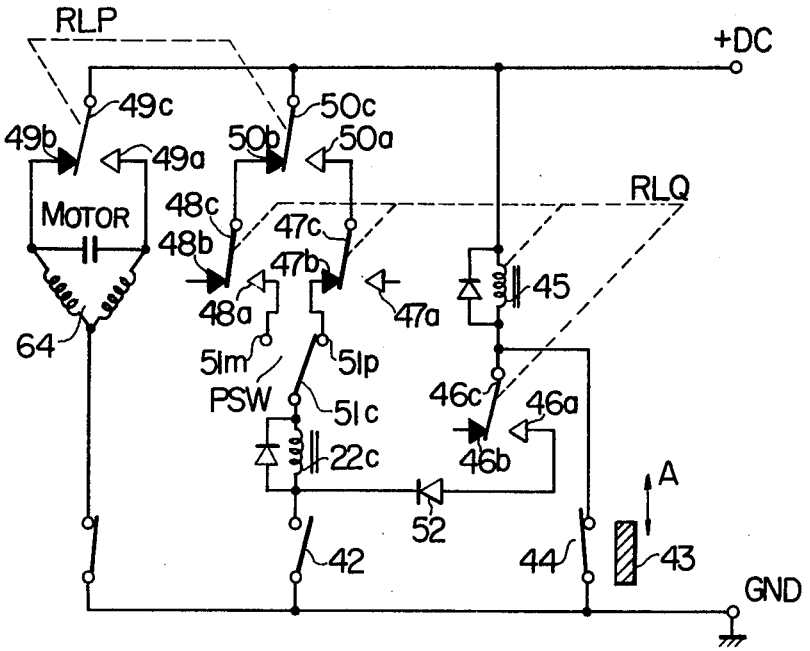
FIG. 10 is a circuit diagram showing the control system.

The control circuit of FIG. 10 is so constructed as to operate the switching system of FIG. 9 in the following manner: When the prism lens 83 is in alignment with the optical axis O—O, the returning of the optical box 7 to the stationary position causes the switch 44 to be closed by the magnetic force of the magnet 43. A current flows between the power supply +DC and GND through the coil 45 of the relay RLQ and the switch 44, thereby bringing the contacts 46c, 47c and 48c of the relay RLQ into contact with the fixed contacts 46a, 47a and 48a respectively. Reference character RLP shows a relay contact for reversible control of the motor 64. The relay contacts 49c and 50c are brought into contact with the contacts 49a and 50a respectively when the optical box 7 moves in the direction of arrow A; while they are brought into contact with the contacts 49b and 50b when the optical box 7 moves in the direction of arrow B.

If an inverted-image copy is to be produced by the use of the prism lens 83, for example, the movable contact 51c of the manual switch PSW is brought into contact with the fixed contact 51p. When the movable contacts 49c and 50c of the relay RLP comes into contact with the fixed contacts 49a and 50a, the motor 64 is started thereby to move the optical box 7 in the direction of arrow A. When the optical box 7 begins to move in the direction of arrow A, the magnet 43 moves away from the switch 44 thereby to cut off the switch 44. Since the limit switch 42 is closed earlier, however, current flows in the coil 45 of the relay RLQ through the contacts 46c and 46a, diode 52, limit switch 42 and GND. Thus the current continues to flow in the relay coil 45. Since the contact 47c remains in contact with the contact 47a, no current flows in the coil 22c of the electromagnet 22. The roller 38 is prevented from projecting into the operating locus of the lever 31, thereby keeping the prism lens 83 in registration with the optical axis O—O. The recording medium unit 12a is thus exposed in an inverted-image condition.

Now, the copying process using the mirror lens 82 will be explained. In this mode of operation, the movable contact 51c of the manual switch PSW is brought into contact with the fixed contact 51m. In the initial stage, the magnet 43 keeps the switch on and therefore the coil 45 of the relay RLQ is energized as in the previous case. When the optical box 7 moves in the direction of arrow A, the contact 50c of the relay RLP is in contact with the contact 50a and therefore the coil 22 is not energized. When the optical box 7 moves in the direction of arrow B, on the other hand, the contact 50c of the relay RLP is brought into contact with the contact 50b, so that current flows in the circuit including the contacts 50c, 50b, 48c, 48a, 51m, 51c, coil 22c, switch 42 and the ground GND in that order. The plunger 22a of the electromagnet 22 is retreated, and the roller 38 projects into the operating locus of the lever 31 into the position as shown by the dashed line in FIG. 4. The lever 31 swings by striking the engaging roller 38. The result is that the lens holder 81 is caused to swing, thereby bringing the mirror lens 82 into alignment with the optical axis O—O. The subsequent returning of the optical box 7 to the stationary position turns off the switch 42 thereby to cut off the current in the coil 22c. Since the magnet 43 is not in contact with the switch 44, the switch 44 remains off and therefore the relay coil 45 is de-energized, thus bringing the contacts 46c, 47c and 48c into contact with the contacts 46b, 47b and 48b respectively. As long as the contact 51c of the switch PSW remains in contact with the contact 51m, the coil 22c of the electromagnet 22 will never be energized. This prevents the engaging roller 38 from projecting, thereby holding the lever 31 stationary.

When it is desired to produce a copy by means of the prism lens 83 again, the contact 51c of the switch PSW is changed over to the contact 51p. With the contact 50c of the relay RLP in contact with the contact 50a, the moving of the optical box 7 away from the stationary position causes the switch 42 to be turned on. A current flows in the circuit including the contacts 50c, 50a, 47c, 47b, 51p, 51c, coil 22c and switch 42 in that order, thereby projecting the engaging roller 38 into the operating locus of the lever 31. Thus, when the lever 31 passes the position of the engaging roller 38, it strikes the engaging roller 38, with the result that the lever 31 rotates into the position shown in FIG. 9 thereby to bring the prism lens 83 into registration with the optical axis O—O. The subsequent operations are as already described.

From the foregoing description, the switching control between the mirror lens 82 and the prism lens 83 of the reflector 8 will have been understood.

The exposure of the recording medium unit 12a is effected as mentioned above. Processes for producing a copy of an information image by electrophotography are conducted in the following manner: First, the recording paper supplied from the paper roll is cut into size by the cutter 14. The resulting recording medium unit has its recording surface uniformly charged as it passes through the charger 15. The recording medium unit 12a is transported and set in a predetermined exposing position (as shown in FIG. 1) by the carrier belt 17. Subsequent movement of the optical box 7 causes the recording surface of the recording medium unit 12a to be exposed to light associated with the image of the original located on the original station 2. As a result of this exposure process, an electrostatic latent image is formed on the recording medium unit 12a. If a copy is desired as a copy master in this case, the movable contact 51c of the manual switch PSW is to be brought into contact with the fixed contact 51p. When the copy is used as a final copy, in contrast, the movable contact 51c of the manual switch PSW is required to be brought into contact with the fixed contact 51m. As long as the movable contact 51c of the manual switch PSW is in contact with the fixed contact 51p, the prism lens 83 effectively works in the reflector 8 thereby to form an inverted electrostatic latent image as described above. When the movable contact 51c is in contact with the fixed contact 51m, on the other hand, the mirror lens 82 works effectively to produce an erect copy image. The recording medium unit 12 formed with an electrostatic latent image is transported to the developer 19, where the unit 12a is developed by a developing unit with a toner of desired color (developing unit 19c of cyan in the case of FIG. 1). If the color separation filter 11 is used for exposure, a developing unit with a toner with the color corresponding to the filter 11 is selected. By producing three copy masters of yellow, magenta and cyan in color through the color separation filter 11, it is possible to produce a color image by transferring them to a secondary recording medium on which the copy masters are overlaid.

It will be now understood from the above description that, according to the present invention, a copy image is obtained either in an erect or inverted form. Therefore, the electrophotographic apparatus according to the present invention may be used for dual purpose of producing an ordinary copy and a copy master.

I claim:

1. An electrophotographic apparatus comprising an original station, a photoconductive recording medium, a charger for uniformly charging the surface of said photoconductive recording medium, means for supporting said uniformly-charged photoconductive recording medium, and an optical system for optically exposing the recording surface of said recording medium to the information image of the original located on said original station, developer means for developing the electrostatic latent image on said recording surface of said recording medium exposed by said optical system, and fixer means for fixing on the recording surface a toner attached to said recording surface in accordance with said latent image, said optical system including a light source and an optical box reciprocally movable along the inside of said original station, said optical box including reflector means for introducing the light reflected on the original to the recording surface of said recording medium, said reflector means including a mirror lens, a prism lens, a lens holder for supporting said mirror lens and said prism lens, a guide rail for slidably supporting said lens holder, and switching means for sliding said lens holder along said guide rail, said developer means including a plurality of developing units each having a toner containing a sublimable dye, said fixer means including a pressure roller for fixing toner on the recording surface, wherein said switching means in said optical system includes a switching lever mounted swingingly on said optical box, said switching lever having an end engaging said lens holder, and an engaging roller adapted to project into the operating locus of said switching lever, said operating locus being traced in response to the movement of said optical box.

2. An electrophotographic apparatus according to claim 1, wherein actuating means are provided for selectively positioning said engaging roller into said operating locus of said switching lever.

3. An electrophotographic apparatus according to claim 2, wherein said actuating means include electromagnetic means for selectively positioning said engaging roller to be engagable with said switching lever.

* * * * *